US006830130B2

(12) United States Patent
Webb et al.

(10) Patent No.: US 6,830,130 B2
(45) Date of Patent: Dec. 14, 2004

(54) METHOD AND APPARATUS FOR TRANSPORTING LOAD BETWEEN TWO VERTICALLY AND HORIZONTALLY SPACED LOCATIONS

(76) Inventors: Wallace W. Webb, 7675 Wickersham, Beaumont, TX (US) 77706; Paul B. Johnson, 601 Orange St., Orange, TX (US) 77630

( * ) Notice: Subject to any disclaimer, the term of this patent is extended or adjusted under 35 U.S.C. 154(b) by 0 days.

(21) Appl. No.: 10/174,122

(22) Filed: Jun. 18, 2002

(65) Prior Publication Data

US 2003/0230453 A1 Dec. 18, 2003

(51) Int. Cl.[7] ..... G06C 7/12
(52) U.S. Cl. ..... 182/129; 182/102
(58) Field of Search ..... 182/129, 101–103; 414/560; 5/85.1

(56) References Cited

U.S. PATENT DOCUMENTS 4,296,509 A * 10/1981 Simmons et al. ..... 5/85.1

5,427,356 A * 6/1995 Krotov et al. ..... 254/324

* cited by examiner

*Primary Examiner*—Alvin Chin-Shue
(74) *Attorney, Agent, or Firm*—Kenneth A. Roddy

(57) ABSTRACT

A vertically placed ladder is positioned approximately 3 to 5 feet from a building and has attached thereto a horizontal beam which is also attached to a vertical stand placed on the roof of the one-story building. The horizontal beam has a U-shaped interior channel within which there is located a roller assembly designed to roll along tracks within the interior of the U-shaped channel, either flat or semi-circular, along the length of the horizontal beam and has attached thereto a winch line which is connectable to a load to be lifted from the earth's surface in a vertical line. The roller assembly also allows the load to be moved along a straight horizontal line until the load is above the surface upon which the load is to be deposited, and then the winch line allows the load to be lowered to the surface upon which the load is to be deposited.

4 Claims, 5 Drawing Sheets

METHOD AND APPARATUS FOR TRANSPORTING LOAD BETWEEN TWO VERTICALLY AND HORIZONTALLY SPACED LOCATIONS

BACKGROUND OF THE INVENTION

1. Technical Field

This invention relates, generally, to load lifting method and apparatus, and specifically, to methods and apparatus for lifting heavy loads, for example, air conditioner compressors from ground level, or near ground level, to levels above the ground, for example, to flat roofs one or two floors above the ground.

2. Background of the Invention

The prior art is replete with attempts to lift heavy objects, for example, air conditioning compressors, from the ground, or from the back of the pickup truck, to a flat roof such as the roof of a one-story commercial building, or to the attic floor of a residential house being constructed.

Most of the prior art attempts to solve the problem involve the use of a ladder, which in the commencement mode, is set up on the ground, several feet from the structure upon which the load is to be lifted, and in a vertical, or near vertical position.

Typical of this prior art approach is the system illustrated and described in U.S. Pat. No. 4,770,273 to W. H. McMakin, et. al. In both of the embodiments illustrated in FIGS. 1 and 2 of that patent, after the load is lifted vertically above the roof level, the load is moved horizontally by either the human operator of FIG. 1 moving backward away from the ladder, or the tripod of FIG. 2 is moved backward to pivot the ladder away from vertical, towards the structure, to thus place the load above the roof. This process is dangerous in that the swinging load and the pivoting ladder can fall and cause damage to property and to the personnel working below.

U.S. Pat. No. 4,911,266 to W. H. McMakin, et al, is a continuation-in-part of U.S. Pat. No. 4,770,273 and also describes the pivoting of the ladder to swing the load over above the roof.

Additional prior art patents include U.S. Pat. No. 4,183,423 to James P. Lewis; U.S. Pat. No. 4,598,795 to Kevin Larson; U.S. Pat. No. 4,690,248 to Walter H. Killeen; U.S. Pat. No. 5,139,108 to Ivan G. Pate; U.S. Pat. No. 5,265,742 to Donald D. Stenger, et al; U.S. Pat. No. 5,738,185 to M. R. Sears; and U.S. Pat. No. 6,244,381 B1 to Timothy E. Ruble.

While each of these prior art patents shows ways for providing a vertical lift to a load, none of them shows a way to move the load horizontally without swinging the load.

3. OBJECTS OF THE INVENTION

It is therefore the primary object of the present invention to provide new and improved methods and apparatus for lifting heavy objects between vertically spaced locations without swinging the objects.

It is also an object of the invention to provide new and improved methods and apparatus for lifting heavy objects between vertically spaced and horizontally spaced locations.

4. BRIEF DESCRIPTION OF THE DRAWINGS

5. DETAILED DESCRIPTION OF THE PREFERRED EMBODIMENT

Figure 1:
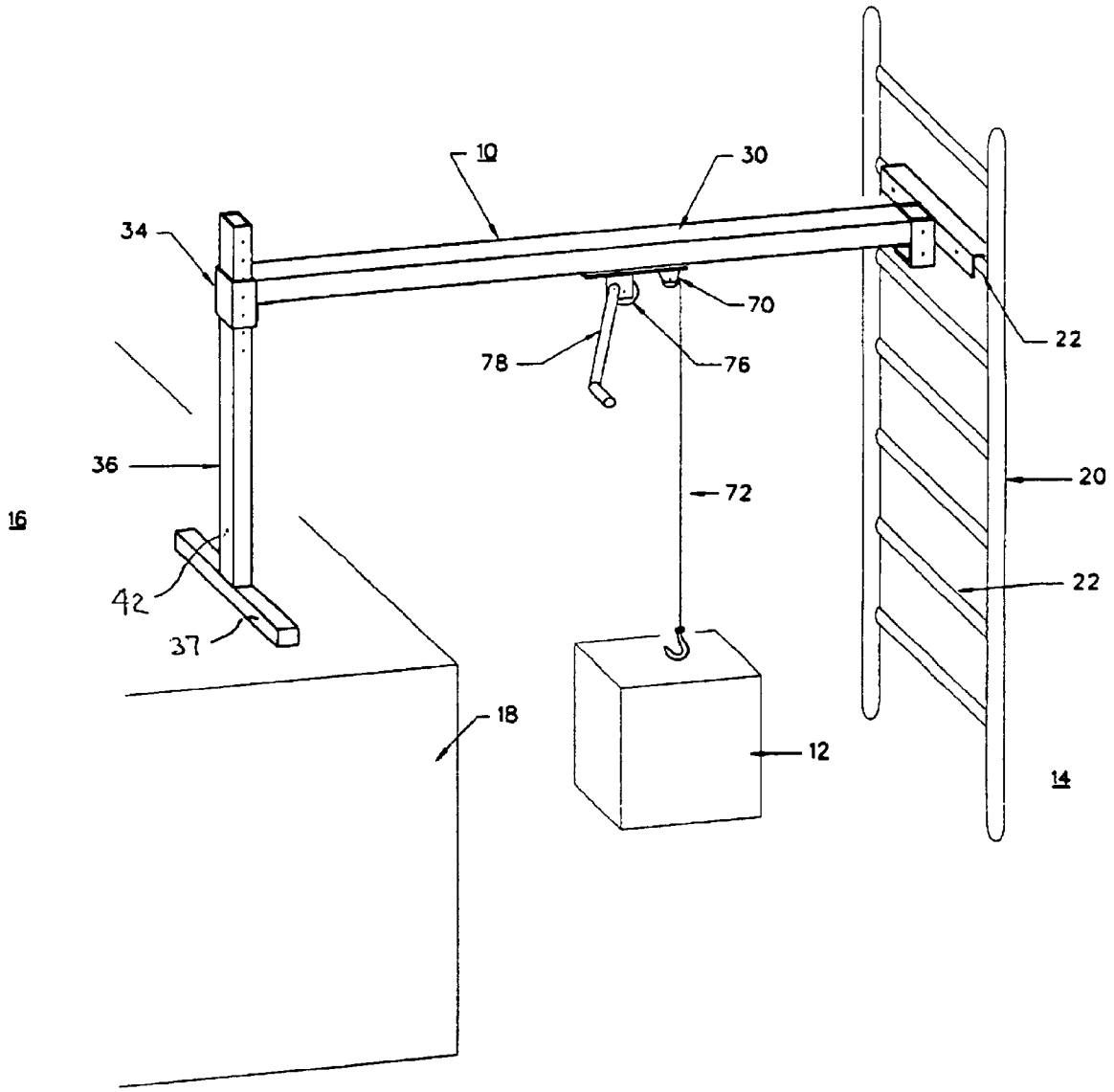
FIG. 1 is a pictorial view of the apparatus according to the invention in which a load is connected from a winch line supported by a horizontal beam having one end carried by a rung of a vertically oriented ladder and a second end located on the roof to which the load is to be transported.

Refer now to the drawings in more detail, in FIG. 1 there is illustrated an apparatus shown generally by the numeral 10, which is used to lift a load 12 from the earth's surface 14 up to the roof 16 of the 1-story structure 18. A conventional ladder 20 having a plurality of step rungs 22 is used in a substantially vertical position with respect to the earth's surface 14 and is typically located some 3–5 feet away from the structure 18.

Figure 2:
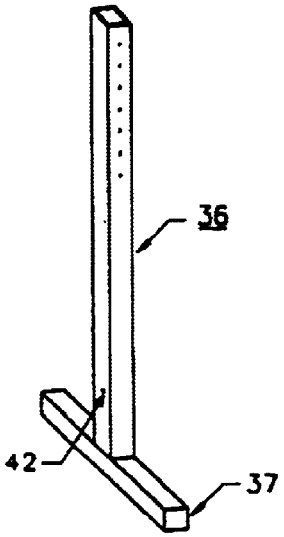
FIG. 2 is a pictorial view of an elongated, vertical, primary stand, in accordance with the present invention.
Figure 4:
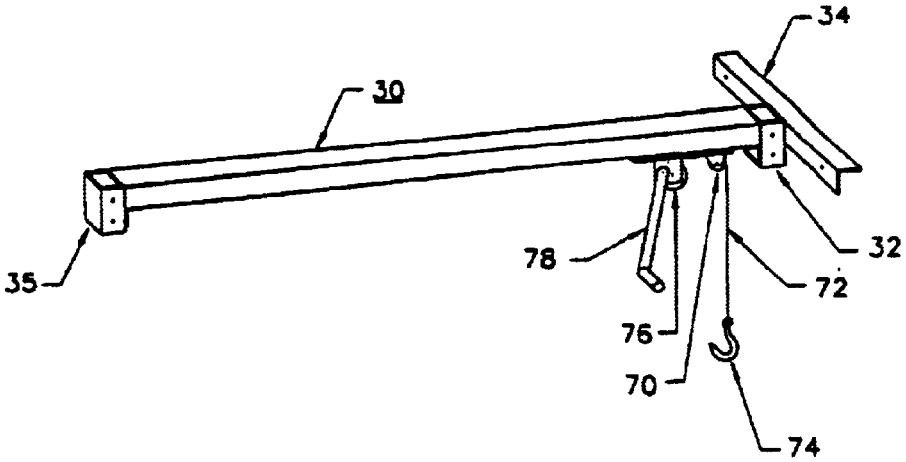
FIG. 4 is a pictorial view of a horizontal beam in accordance with the invention that spans the gap between the vertical ladder illustrated in FIG. 1 and the vertical stand illustrated in FIG. 2.

A horizontal beam 30 such as is illustrated in FIG. 4 is attached at its first end 32 by means of an L-shaped bracket 34 to one of the step rungs 22 and at its other end 35 to the upper end of a primary vertical stand 36 as is illustrated in FIG. 2.

Figure 1A:
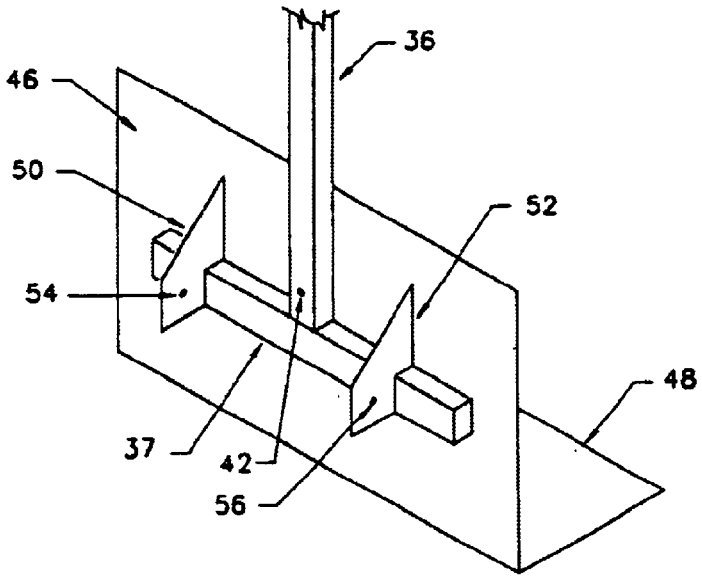
FIG. 1A is a pictorial view of the L-shaped member of the wheel kit of FIG. 6 attached to the lower end of the vertical stand of FIG. 2, shown with the wheel assembly removed.
Figure 1B:
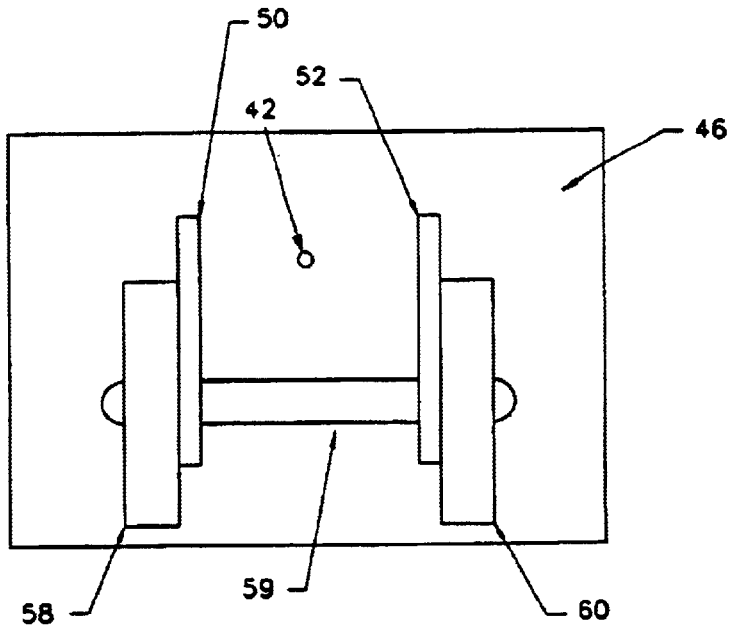
FIG. 1B is an elevation view of the L-shaped member of the wheel kit of FIG. 1A illustrating an axle with two wheels installed thereon.
Figure 6:
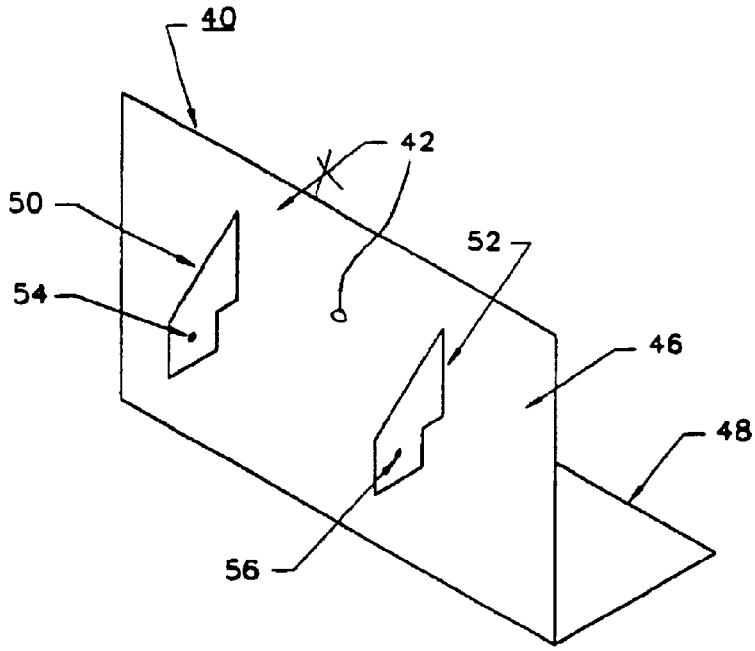
FIG. 6 is a an L-shaped member of wheel kit according to the invention which may be attached to the lower end of the primary vertical stand illustrated in FIG. 2.

The vertical stand 36, in addition to being connected to the horizontal beam 30, may be optionally connected at its lower end to the a wheel kit 40 (FIGS. 1A, 1B and 6). As seen in FIGS. 1A, 1B and 6, the wheel kit 40 is an L-shaped member having a vertical plate 46 and a horizontal plate 48. A pair of wheel struts 50 and 52 extend off the backside of the vertical plate 46 and have holes 54 and 56 there through, respectively, which are used to contain an axle 59 and attached to which are two wheels 58 and 60, respectively. The two wheels 58 and 60 are situated slightly above the plate 48. The optional wheel kit 40 may be attached to the vertical stand 36 by means of a bolt connected through bolt holes 42 in the lower portion of the vertical leg of the vertical stand 36 and the vertical plate 46 of L-shaped member of the wheel kit.

The wheels 58 and 60 of the wheel kit 40 are not used in the load-lifting operation. The wheels 58 and 60 of the wheel kit 40 are not used except when it is desired to move the vertical stand 36 and connected wheel assembly to a given location on the roof 16.

As illustrated in FIG. 1, the T-shaped lower end 37 of the vertical stand 36 may be supported on the roof surface 16 without the wheel kit 40. When the wheel kit 40 is connected to the lower end of the vertical stand 36, the horizontal plate 48 of the L-shaped member rests on the roof surface 16, since the two wheels 58 and 60 are situated slightly above the plate 48 and thus above the roof surface.

Figure 3:
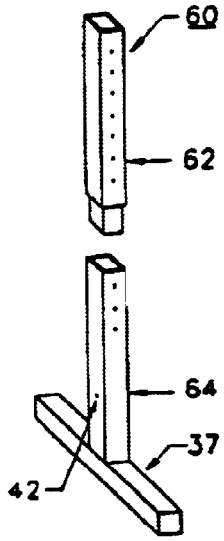
FIG. 3 is a pictorial view of an alternative embodiment of the primary stand illustrated in FIG. 2.

FIG. 3 illustrates an optional vertical stand 60 having a pair of stand member 62 and 64 which can be used if desired to enable the use of a different rung of the ladder 20 to provide an increased or decreased height above the surface 16 illustrated in FIG. 1. As is used in FIGS. 2 and 3, the primary stand in each instance will have a T-shape 37 at its lower end to provide mechanical stability with the L-shaped members having the vertical plate 46 and the horizontal plate 48.

Referring now further to FIG. 4, there is illustrated a pulley 70 over which a line 72 having a hook 74 at its lower end passes. Line 72 also passes over a second pulley 76 having a rotatable handle 78, the rotation of which causes the load 12 to be lifted or lowered vertically.

Figure 5:
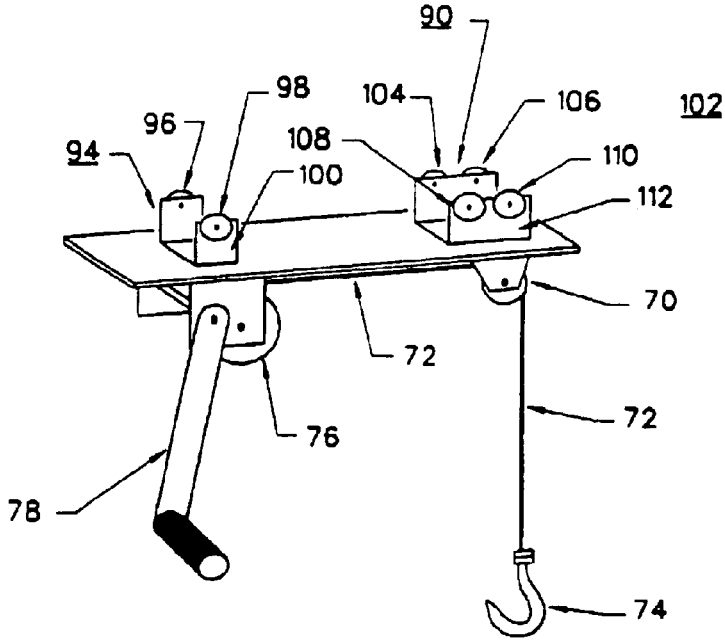
FIG. 5 is a pictorial view of a roller assembly used within the horizontal beam illustrated in FIG. 4.

Referring now to FIG. 5, there is illustrated a roller assembly 90 which is designed to roll along within the interior of the horizontal beam 30. The roller assembly 90 includes a guide roller assembly 94 upon which is mounted a pair of rollers 96 and 98 on opposite sides of a U-shaped support member 100. It should be appreciated that the single guide roller 94 is used to provide stability to the roller assembly 90 as the assembly 90 moves along within the interior of the horizontal beam 30. Roller assembly 90 also includes a load-bearing roller mechanism 102 having four rollers 104, 106, 108 & 110, with the rollers 104 & 106 being mounted on opposite sides of the U-shaped support mechanism 112 from rollers 108 and 110. As is also illustrated in FIG. 1, rotation of the handle 78 causes the line 72 to pass over the pulleys 70 & 76 and to thereby act as a winch line connected to the hook 74 and to thereby lift the load 12 along a straight vertical line beside the structure 18.

Figure 7:
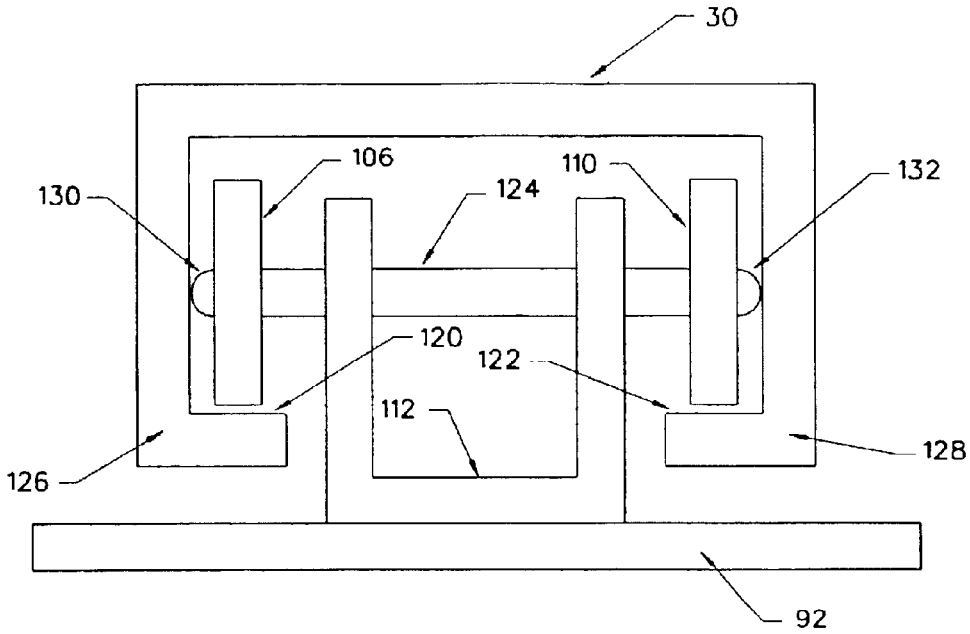
FIG. 7 is a cross-sectional view taken along the sectional line 7—7 of the horizontal beam illustrated in FIG. 4, including the roller assembly illustrated in FIG. 5 being used within the horizontal beam illustrated in FIG. 4.

As illustrated in FIG. 7, horizontal beam 30 is essentially a U-shaped channel having internal surfaces 120 and 122 upon which a pair of rollers 106 and 110 can be rolled. As a view from another perspective, the rollers 104 and 108 will also be seen as rolling along the same two surfaces 120 and 122, respectively. The rollers 106 and 110 ride on an axle 124 passing through the U-shaped member 112. It should be appreciated that the support member 112 is sized to fit within the inward extensions 126 and 128 having the surfaces 120 & 122 upon them, respectively. If desired, the hubs 130 and 132 projecting from the rollers 106 and 110, respectively, can themselves be ball bearings or some other such low friction device to avoid drag between the rollers 106 and 110 and the internal side walls of the channel member 30.

In the operation of the present invention, it should be appreciated that as a first step in the process, the ladder 20 is first positioned vertically with its bottom end engaged on the earth's surface a short distance, some 3–4 feet from the structure 18, as illustrated in FIG. 1. The horizontal beam 30 will have already been latched onto the ladder rung 22 at a pre-selected height and if desired, the other end of the beam 30 can already be attached to the vertical member 36 or the vertical member 60, of FIGS. 2 or 3, respectively. As shown in FIG. 1, the T-shaped lower end 37 of the vertical stand 36 or 60 may be supported on the roof surface 16 without the wheel kit 40. Optionally, the wheel set 40 with its axle and wheels in place, may also have been attached to the lower end of the vertical stand 36 or 60, with the horizontal plate 48 of the L-shaped member resting on the roof surface 16 and its wheels situated slightly above the plate 48 and above the roof surface. Either the vertical stand 36, 60 and/or the ladder 20 can be adjusted accordingly in the desired positions. The line 72 with its hook 74 is then attached to load 12. The handle 78 is then rotated to raise the load 12 in a straight vertical line up above the surface 16 of the structure 18. As soon as the load 12 has been raised above the surface 16, the roller assembly 90 illustrated in FIG. 4 can be moved along the inside of the beam 30 by pulling on the handle 78 or any other means as desired to make the rollers move the weight 12 in a straight horizontal line along towards the upper surface 16 of the structure 18. Thus, the present apparatus remains stationary relative to the earth's surface and the roof surface during both, the vertical lifting and the horizontal movement of the load. If desired, the pulley 76 and/or the pulley 70 can be run on ratchet devices which allow the load 12 to move only in the up direction. Also, if desired, the structure illustrated in FIGS. 1–7 can be used to lower the load 12 by sliding the roller assembly by hand back in a direction towards the ladder and then by rotating the handle 78 in the opposite direction to lower the load 12 back to the earths surface, or on to the back of a pickup truck, for example, if desired.

Figure 7A:
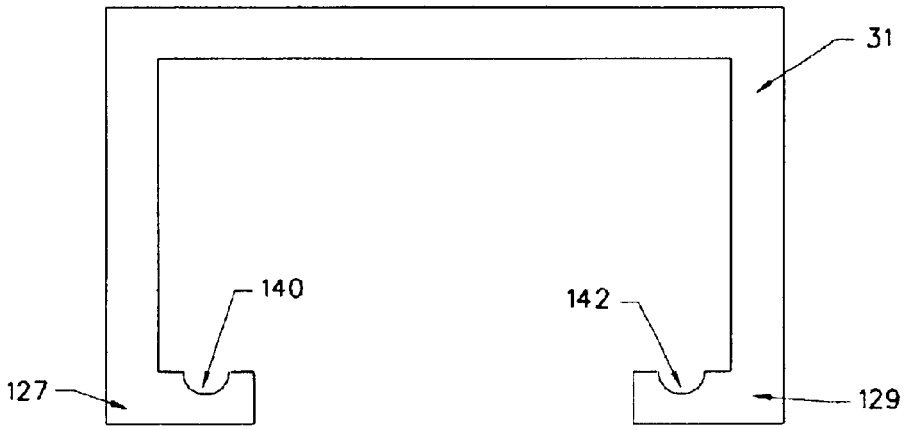
FIG. 7A is an alternative embodiment of the horizontal beam illustrated in FIG. 7.

Referring now to FIG. 7A, the horizontal beam 30 of FIG. 7 is shown as a modified horizontal beam 31, in which the inward extensions 126 and 128 of FIG. 7 have been modified and designated as extensions 127 and 129, respectively. The extensions 127 and 129 have semi-circular tracks 140 and 142, respectively, and are sized to accommodate the wheels 104, 106, 108 and 110, as well as the guide rollers 94 and 96. With the use of the tracks 140 and 142, there will be a reduction of any tendency of the roller assembly to generate friction by rubbing up against any portion of the horizontal beam 31.

Thus there has been described and illustrated herein the preferred embodiment of the present invention in which there are methods and apparatus disclosed for raising a load up above the surface of a structure and then for moving the load horizontally over to the position above the surface of the structure where the load can then be lowered onto the surface of the structure.

What is claimed is:

1. An apparatus for moving a load from a first level at or near the earth's surface to a roof surface disposed at a second level and vice versa, said second level being spaced a distance vertically above and horizontally from said first level, comprising:

a ladder having a bottom end adapted to engage the earth's surface and plurality of step rungs;

a vertical stand having an inverted T-shaped lower end adapted to be supported on or in proximity to the roof surface, and an upper end;

an L-shaved member having a vertical portion removably connected to said inverted T-shaped lower end of said vertical stand and a horizontal portion adapted to engage the roof surface and support said lower end of said vertical stand in close proximity to the roof structure;

a horizontal beam having an interior, a first end connected to said upper end of said vertical stand, and a second end connected to one of said step rungs of said ladder;

a traveling roller assembly mounted within said interior of said horizontal beam for longitudinal movement relative thereto; and a first pulley and a second pulley spaced therefrom carried by said roller assembly, a winch line wound on said first pulley and passing over said second pulley and having a free end adapted to be connected to the load, and a hand crank connected with said first pulley for rotating the same;

said hand crank being operative to rotate said first pulley in a first direction to raise the load along a straight vertical line and in a second direction to lower the load along a straight vertical line;

said traveling roller assembly being operative to move the load in a raised position along a straight horizontal line relative to and between said ladder and said vertical stand; and said ladder, said vertical stand, said L-shaped member, and said horizontal beam remaining stationary relative to the earth's surface and the roof surface during both, the vertical lifting and the horizontal movement of the load.

2. The apparatus according to claim 1, wherein said horizontal beam is an inverted generally U-shaped channel member having inwardly facing laterally spaced extensions at a bottom end defining first and second internal tracks for accommodating and supporting said roller assembly.

3. The apparatus according to claim 1, wherein said horizontal beam has a bracket at said second end for connecting said second end to one of said step rungs of said ladder.

4. The apparatus according to claim 1, further comprising:

a pair of wheels rotatably mounted on said vertical portion of said L-shaped member in laterally spaced relation, said wheels disposed a short distance vertically above said horizontal portion of said L-shaped member and above the roof surface;

said wheels being operative to move said vertical stand to a desired location on the roof surface.

* * * * *